United States Patent [19]

Levitt

[11] 4,148,421

[45] Apr. 10, 1979

[54] HANGER

[75] Inventor: Herbert Levitt, Yonkers, N.Y.

[73] Assignee: Warnaco, Inc., Bridgeport, Conn.

[21] Appl. No.: 884,915

[22] Filed: Mar. 9, 1978

[51] Int. Cl.[2] ..... A47J 51/097

[52] U.S. Cl. ..... 223/87; 211/113; 223/91

[58] Field of Search ..... 223/85, 87, 88, 91, 223/92, 93, 96; 211/113, 119

[56] References Cited

U.S. PATENT DOCUMENTS

| | | | |
|---|---|---|---|
| 1,434,712 | 11/1922 | Launder | 223/88 X |
| 1,833,388 | 11/1931 | Carmack | 223/88 |
| 2,099,596 | 11/1937 | Brueing | 223/88 |
| 2,232,028 | 2/1941 | Isaak | 223/88 |
| 2,279,777 | 4/1942 | Dean | 223/88 |
| 2,499,538 | 3/1950 | Staton | 223/88 |
| 2,991,919 | 7/1961 | Zuckerman | 223/88 |
| 3,406,882 | 10/1968 | Phillips | 223/88 |
| 3,463,369 | 8/1969 | Moskowitz | 223/91 |

FOREIGN PATENT DOCUMENTS

| | | | |
|---|---|---|---|
| 494535 | 10/1938 | United Kingdom | 223/87 |
| 889870 | 2/1962 | United Kingdom | 223/88 |

*Primary Examiner*—George H. Krizmanich
*Attorney, Agent, or Firm*—Amster, Rothstein & Engelberg

[57] ABSTRACT

A clothes hanger which is particularly adapted to suspend a plurality of articles of apparel. The hanger has a body portion including an elongated bar for suspending a first article of clothing, a pair of downwardly opening elongated slots at each end of the body portion for suspending a second article of clothing, and a pair of sideways opening elongated slots located above the pair of downwardly opening slots for suspending a third article of clothing from the hanger.

2 Claims, 5 Drawing Figures

HANGER

DESCRIPTION OF THE INVENTION

The present invention relates generally to hangers, and more particularly to hangers for suspending various articles of clothing at one time.

Clothes hangers capable of suspending more than one article of clothing are known. For example, the primary embodiment of the hanger disclosed and claimed in U.S. Pat. No. 3,710,993 to Collin includes a pair of wire clips extending downwardly from its bottom bar and a pair of inwardly facing clips formed at respective ends of the hanger. Each pair of clips may be used to secure a garment to the hanger, however, it will be appreciated that this hanger has certain attendant disadvantages. For example, because of the orientation of the inwardly facing clips at the bottom ends of the hanger, they are of no practical use for securing a garment other than one which is already draped over the lower bar of the hanger. Moreover, once a garment is draped across the lower hanger bar, it becomes impractical and inconvenient to suspend another garment from either pair of resilient clips.

Manufacture of the Collin hanger requires a number of time-consuming operations to form each of the clips from the single wire of which the entire hanger is made, thereby substantially increasing the production of the hanger over conventional wire hangers.

In order to be able to suspend more than one garment on a single hanger, other prior art inventions have recognized the necessity for auxiliary devices to be used in conjunction with conventional hangers. For example, U.S. Pat. Nos. 3,307,753 to Levine, et al. and 3,116,860 to Urich disclose such devices and thereby illustrate the additional cost and complexity of hanging assemblies capable of functioning in a manner comparable to the present invention.

The present invention relates to a hanger comprising a hanger body portion having an elongated bar for suspending a first article of clothing from the hanger, a pair of downwardly opening elongated slots at each end of the body portion for suspending a second article of clothing from the hanger, and a pair of sideways opening slots located above the pair of downwardly opening slots for suspending a third article of clothing from the hanger.

The hanger is preferably formed of a single, generally flat convoluted strip of plastic material, the strip defining a hook portion extending centrally upwardly from a hanger body portion. One end of the strip which defines the hanger body portion is also preferably spaced from the hook portion so as to form an opening through which the first article of clothing can be passed and thereafter suspended from the elongated bar in the hanger body.

Accordingly, it is an overall object of the present invention to overcome the shortcomings of the prior art and to provide a hanger that is convenient to use and low in cost to produce.

It is a further object of the present invention to provide a hanger that can independently suspend three different articles of clothing at one time.

It is a still further object of the present invention to provide a hanger that can be molded in the form of a single "S"-shaped strip of plastic material including an integral hook portion thereby lowering costs of fabrication.

In accordance with an illustrative embodiment demonstrating objects and features of the present invention, there is provided a hanger having a generally flat hanger body portion. The body portion includes an elongated, substantially horizontal bar for suspending a first article of clothing from said hanger. The hanger body portion also contains a first pair of downwardly opening elongated slots. Each slot in the first pair of slots is located at a respective end of the body portion below the transverse medial line of the body portion so that the first pair of slots will suspend a second article of clothing from the hanger. The hanger body portion further includes a second pair of sideways opening elongated slots. Each slot in the second pair of slots is located above the transverse medial line of the body portion adjacent a corresponding slot in the first pair of slots. The second pair of slots is constructed and arranged to suspend a third article of clothing from the hanger. The hanger also includes a hook portion extending upwardly from the body portion from the center of the body portion.

The above description as well as further objects, features, and advantages of the present invention will be more fully understood by reference to the following detailed description of the presently preferred, but nonetheless illustrative embodiment in accordance with the present invention, when taken in conjunction with the accompanying drawings, wherein.

Figure 1:
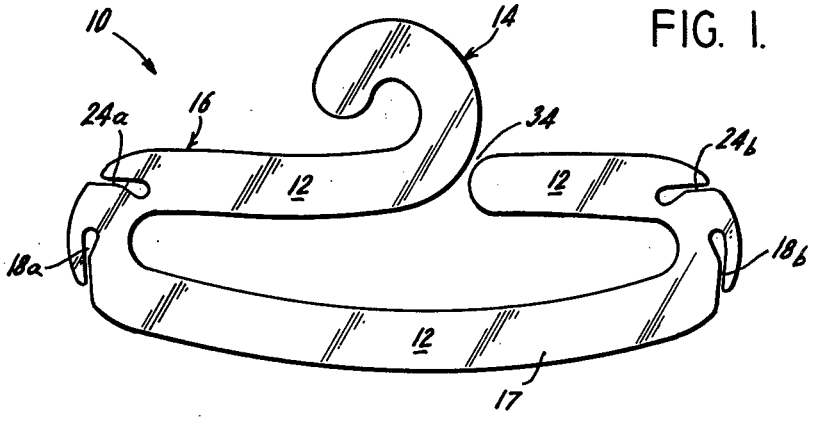
FIG. 1 is a front elevational view of the clothes hanger of the present invention.
Figure 2:
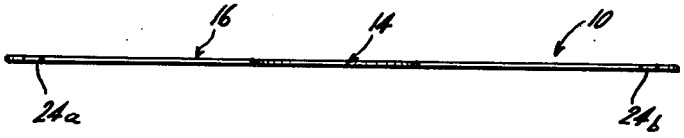
FIG. 2 is a top plan view of the hanger of FIG. 1.
Figure 3:
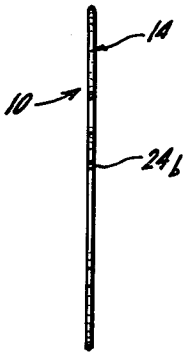
FIG. 3 is a side elevational view of the hanger of FIG. 1.

Referring now in detail to the drawing and particularly to FIGS. 1, 2 and 3 thereof, there is shown an illustrative clothes hanger embodying features of the present invention, generally designated by the reference numeral 10, which is preferably formed of a generally flat strip 12 of moldable plastic material, the strip 12 being molded in an "S"-shaped convoluted form as shown in FIG. 1 so as to define a hook portion 14 which extends upwardly and centrally from a hanger body portion 16. Strip 12 also forms an elongated, substantially horizontal flat bar 17 across the bottom of the hanger 10.

FIG. 2 is a top plan view, and FIG. 3 is a side elevational view of the hanger 10 shown in FIG. 1, it being seen that hanger 10 is in generally planar form, thereby facilitating ease of handling and storage of large quantities of the present hanger.

Figure 5:
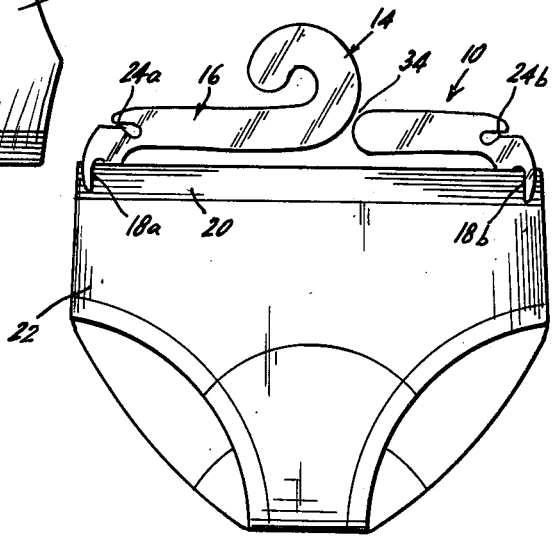

Referring again to FIG. 1, hanger 10 has a pair of downwardly opening elongated slots **18*a* and 18*b* formed in the vicinity of respective ends of hanger body portion 16, adjacent the lateral extremities and below the transverse medial line of the body portion 16. Slots 18*a*, 18*b* are each preferably formed with a relatively narrow spacing which leads to a larger opening at the top of each of them, as shown. For example, slots 18*a*, 18*b* may be formed so as to secure a waistband 20 on a pair of briefs 22, as shown in FIG. 5, once the waistband 20** is moved through the relatively narrow spaces and up into the wider openings of the slots.

Figure 4:
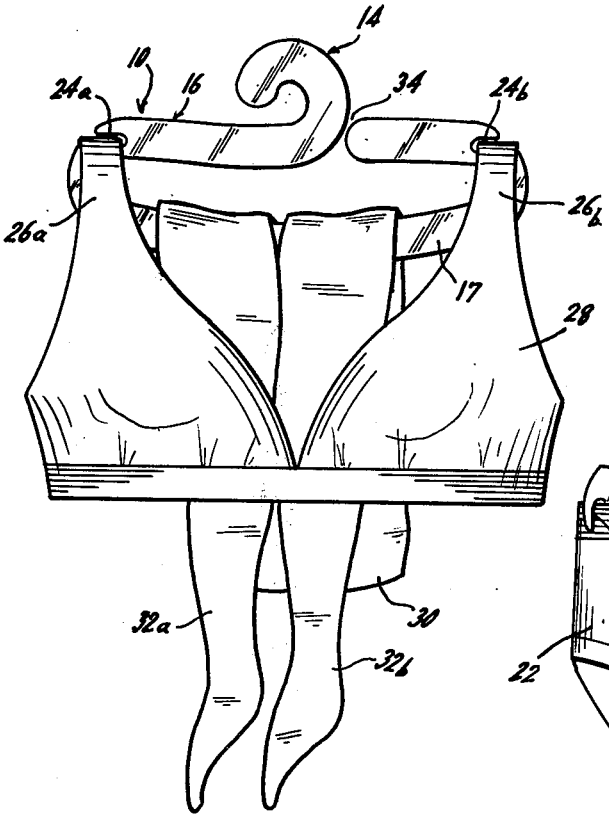
FIGS. 4 and 5 illustrate the utilization of the hanger of the present invention to hang various articles of clothing.

A pair of sideways opening elongated slots **24*a* and 24*b* are also formed in hanger body portion 16 above each of slots 18*a* and 18*b***, respectively. Each of the slots 24a, 24b are also preferably formed with a relatively narrow spacing which leads to a wider opening at the ends of the slots as shown in FIG. 1. Slots 24a, 24b are arranged to receive and secure straps 26a, 26b, respectively, on an article of clothing such as, for example, a brassiere 28 as shown in FIG. 4. It will be understood that if slots 24a, 24b are formed so that their respective widened openings are tapered downwardly, as shown in FIG. 1, then an article of clothing such as brassiere 28 can be suspended from hanger 10 by way of its straps 26a, 26b. The straps are thereby steadily maintained within slots 24a, 24b.

The bar 17 of hanger 10 can be used to suspend still other articles of clothing such as, for example, a pair of panty hose 30, as shown in FIG. 4. Legs 32a and 32b of panty hose 30 can be draped over the bar 17, and brassiere 28 can be suspended from slots 24a, 24b at the same time.

It will also be appreciated that the briefs 22, brassiere 28 and panty hose 30 or similar articles may all be suspended from hanger 10 at once, preferably by way of first suspending the briefs 22 from slots 18a, 18b; then draping the panty hose 30 over the bar 17; and next suspending brassiere 28 by placing its straps 26a, 26b into slots 24a, 24b, respectively.

The preferred construction of the present hanger 10, as shown in FIG. 1, includes an opening 34 between the first end of the strip 12 which defines the hanger body portion 16 and the second end of strip 12 which defines hook portion 14. Opening 34 thereby allows an article of clothing to be draped across the bar 17 after sliding it therethrough, without having to slide the article over the bar 17. In the event an article such as panty hose 30, for example, is to be suspended over the bar 17, it will be appreciated that the possibility of snagging, tearing or otherwise damaging the panty hose is significantly reduced by merely sliding it through the opening 34 and over bar 17.

Accordingly, the present invention provides a clothes hanger of narrow profile which is capable of suspending a number of different articles of clothing at any given time. The hanger is of relatively simple construction and can be easily fabricated from inexpensive materials, thereby attaining low cost.

The use of plastic or similar materials in the construction of the hanger of the present invention allows it to be used for drying articles of clothing that have been washed. The plastic material eliminates the danger of the hanger causing rust stains on the articles.

A latitude of variation, modification, change and substitution is intended in the foregoing disclosure. For example, it will be apparent to the worker skilled in the art that the sideways opening slots 24a, 24b may be formed so as to face inwardly rather than outwardly as shown in the drawing. Also, the hanger may be made from wood or metallic material as well as plastic material, provided sufficient rigidity is obtained to prevent deformation of the hanger when it is fully loaded with articles of clothing. Therefore, it is appropriate that the appended claims be construed broadly and in a manner consistent with the spirit and scope of the invention.

What is claimed is:

1. A hanger for suspending various articles of clothing comprising a flat continuous strip of substantially rigid material, said strip extending convolutely from a free end thereof to define a flat hanger body portion having a relatively wide, elongated opening therein, said strip forming an elongated bar extending over the entire width of said body portion at the bottom of said opening for suspending a first article of clothing passed into said opening from said hanger, said strip further extending centrally from the top of said hanger body portion to the other end thereof to form a hook for said hanger, said hook confronting the free end of said strip to define a smoothly contoured passage through which said first article of clothing can be passed directly into the central portion of said opening to be suspended by said elongated bar, said body portion having a first pair of downwardly opening elongated slots, each of said first pair of slots being formed in a corresponding end of said body portion in the vicinity of respective ends of said elongated bar and having a relatively narrow spacing which leads to a wider opening at the end of each slot, respectively, for suspending a second article of clothing from said hanger.

2. A hanger according to claim 1, wherein said body portion has a second pair of outwardly opening slots, each of said second pair of slots being formed in said body portion adjacent and above corresponding ones of said first pair of slots, respectively, for suspending a third article of clothing from said hanger.

* * * * *